US012636701B2

(12) United States Patent
Kim et al.

(10) Patent No.: US 12,636,701 B2
(45) Date of Patent: May 26, 2026

(54) ALLOY POWDER AND PREPARATION METHOD THEREFOR

(71) Applicants: LG ELECTRONICS INC., Seoul (KR); RESEARCH & BUSINESS FOUNDATION SUNGKYUNKWAN UNIVERSITY, Gyeonggi-do (KR)

(72) Inventors: Byungsung Kim, Seoul (KR); Seongsoo Lee, Seoul (KR); Inhwan Lee, Gyeonggi-do (KR); Dongmok Whang, Gyeonggi-do (KR)

(73) Assignees: LG ELECTRONICS INC., Seoul (KR); RESEARCH & BUSINESS FOUNDATION SUNGKYUNKWAN UNIVERSITY, Gyeonggi-Do (KR)

( * ) Notice: Subject to any disclaimer, the term of this patent is extended or adjusted under 35 U.S.C. 154(b) by 399 days.

(21) Appl. No.: 18/245,303

(22) PCT Filed: Aug. 31, 2021

(86) PCT No.: PCT/KR2021/011641
§ 371 (c)(1),
(2) Date: Mar. 14, 2023

(87) PCT Pub. No.: WO2022/059966
PCT Pub. Date: Mar. 24, 2022

(65) Prior Publication Data

US 2023/0364678 A1 Nov. 16, 2023

(30) Foreign Application Priority Data

Sep. 21, 2020 (KR) ..... 10-2020-0121267

(51) Int. Cl.
*B22F 9/22* (2006.01)
*B22F 1/054* (2022.01)
(Continued)

(52) U.S. Cl.
CPC ..... *B22F 9/22* (2013.01); *B22F 1/054* (2022.01); *B22F 1/056* (2022.01); *C22C 1/04* (2013.01);
(Continued)

(58) Field of Classification Search
None
See application file for complete search history.

(56) References Cited

U.S. PATENT DOCUMENTS 4,411,825 A 10/1983 Domeniconi
2010/0310950 A1* 12/2010 Min ..... H01M 4/921 502/313

FOREIGN PATENT DOCUMENTS

CN 102049525 5/2011
CN 111545767 8/2020
(Continued)

OTHER PUBLICATIONS

English translation of CN 111545767 (originally published Aug. 18, 2020), obtained from PE2E search.*
(Continued)

*Primary Examiner* — Melvin C. Mayes
(74) *Attorney, Agent, or Firm* — LEE, HONG, DEGERMAN, KANG & WAIMEY

(57) ABSTRACT

An alloy powder preparation method according to an embodiment comprises the steps of: forming a mixture by mixing a plurality of metal compounds; and thermally treating the mixture, wherein, in the step of thermally treating the mixture, the process temperature changes according to the particle diameter of alloy powder. In addition, the step of thermally treating the mixture proceeds through hydrogen reduction at a process temperature of 300 to 700° C.

1 Claim, 3 Drawing Sheets

(51) Int. Cl.
*C22C 1/04* (2023.01)
*C22C 30/02* (2006.01)

(52) U.S. Cl.
CPC ..... *C22C 30/02* (2013.01); *B22F 2203/11* (2013.01); *B22F 2304/056* (2013.01); *B22F 2304/058* (2013.01); *B22F 2998/10* (2013.01)

(56) References Cited

FOREIGN PATENT DOCUMENTS

| | | | | |
|---|---|---|---|---|
| CN | 114042928 | A | * | 11/2021 |
| EP | 0575190 | | | 12/1993 |
| JP | WO2018-181568 | | | 4/2019 |
| KR | 10-2010-0076824 | | | 7/2010 |
| KR | 10-2010-0131237 | | | 12/2010 |
| KR | 10-2019-0022881 | | | 3/2019 |
| WO | WO-2004/064181 | A2 | * | 7/2004 |

OTHER PUBLICATIONS

European Patent Office Application Serial No. 21869588.0, Search Report dated Sep. 27, 2024, 11 pages.
Yang et al., "Aerosol Synthesis of High Entropy Alloy Nanoparticles," Langmuir, vol. 36, No. 8, Feb. 2020, 8 pages.
PCT International Application No. PCT/KR2021/011641, International Search Report dated Nov. 25, 2021, 4 page.
Korean Intellectual Property Office Application No. 10-2020-0121267, Office Action dated Feb. 11, 2026, 6 pages.

* cited by examiner

【Fig. 1】
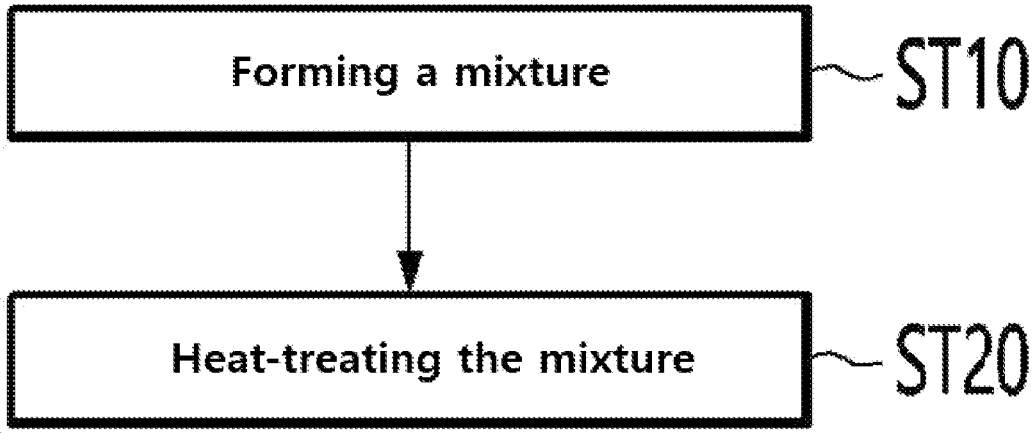
【Fig. 2】
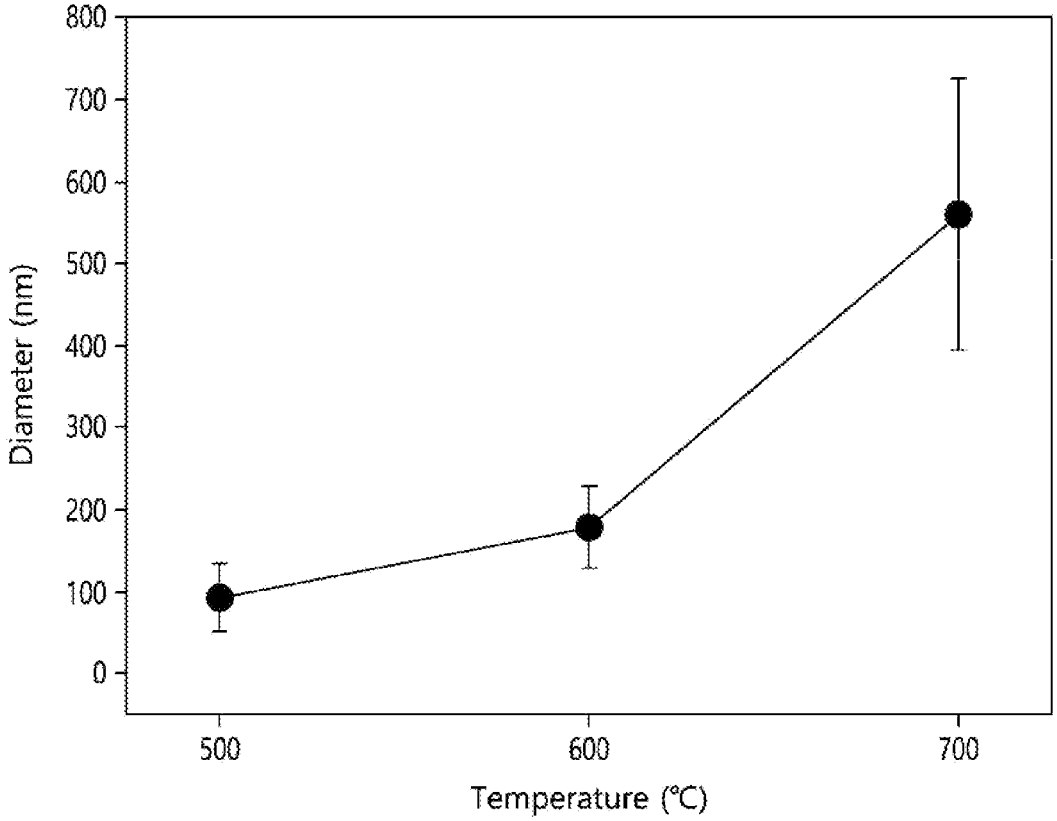

【Fig. 3】
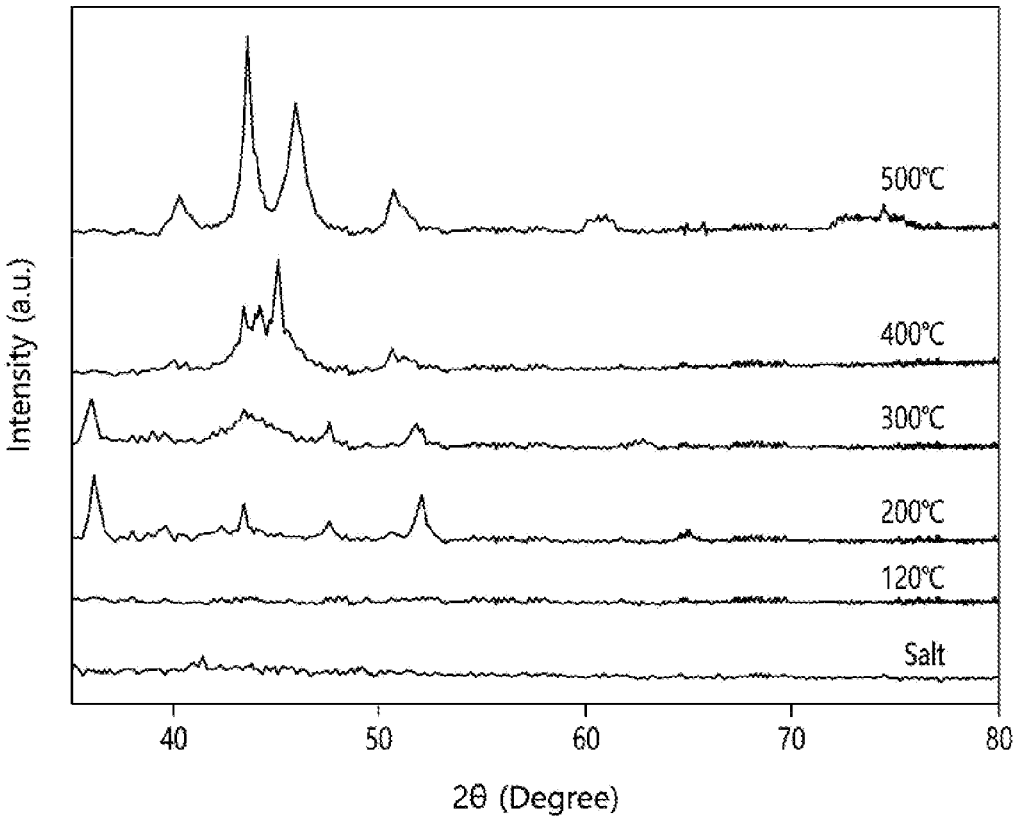
【Fig. 4】
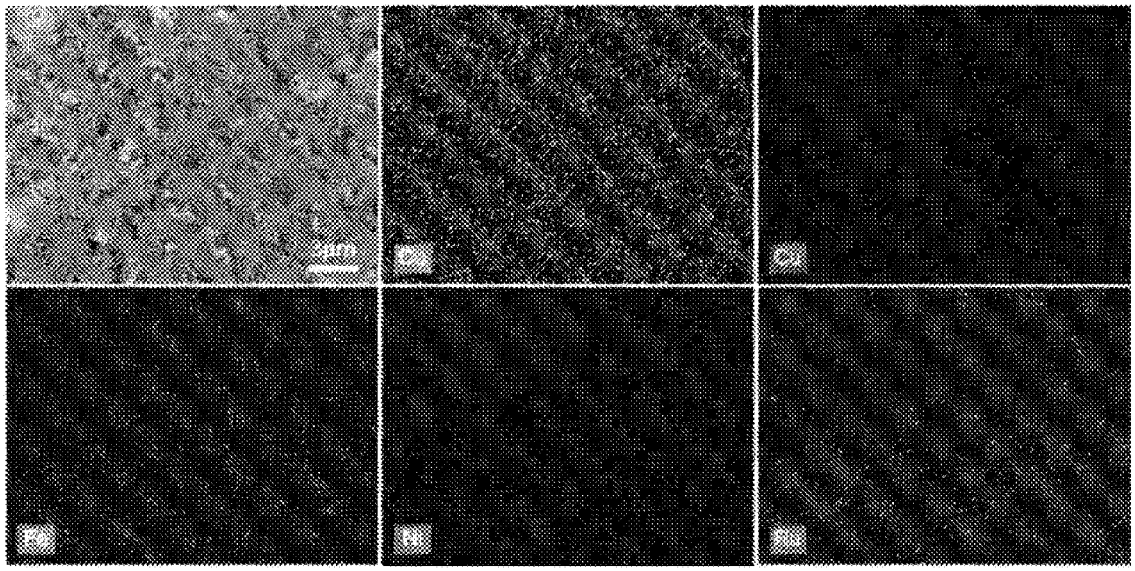

【Fig. 5】
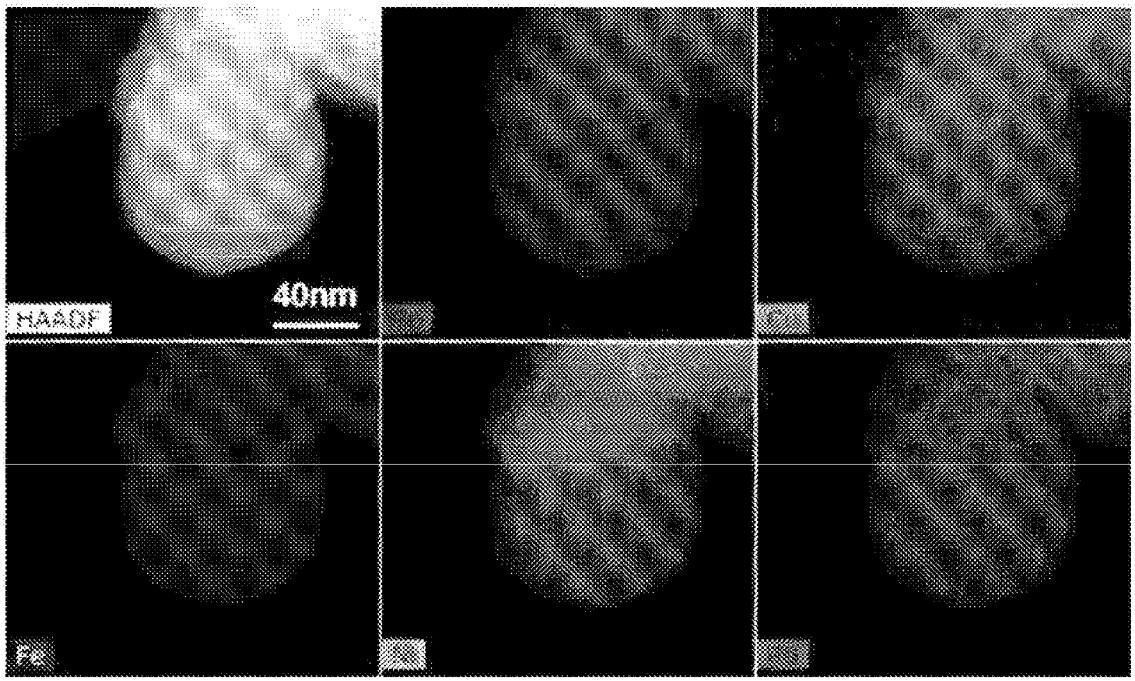
【Fig. 6】
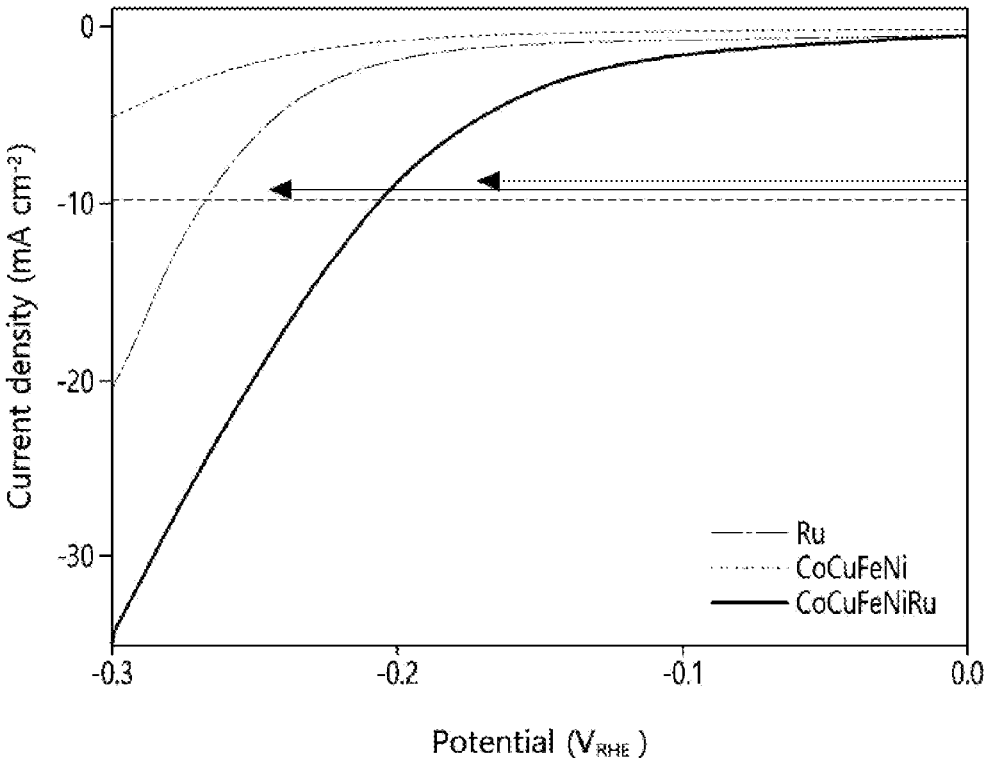

ALLOY POWDER AND PREPARATION METHOD THEREFOR

CROSS-REFERENCE TO RELATED APPLICATION(S)

This application is the National Stage filing under 35 U.S.C. 371 of International Application No. PCT/KR2021/011641, filed on Aug. 31, 2021, which claims the benefit of earlier filing date and right of priority to Korean Application No. 10-2020-0121267, filed on Sep. 21, 2020, the contents of which are all hereby incorporated by reference herein in their entireties.

TECHNICAL FIELD

An embodiment relates to an alloy powder and preparation method thereof.

BACKGROUND ART

An alloy powder uses a sintering phenomenon in which raw material powder is compressed and heated to cause diffusion between the individual particles so that the powder adheres to each other. After forming the raw material powder into a desired product shape using this phenomenon, the molded body is sintered at a temperature below the melting point of the constituent components to manufacture the necessary product. The alloy powder has the advantage of reducing the post-processing cost and facilitating control of the alloy composition.

Meanwhile, the multi-component high entropy alloy powder constitutes an alloy of a plurality of elements mixed in a constant composition, and forms solid solution alloys having high mixing entropy.

The multi-component high entropy alloy powder is mainly produced by melting and casting, and the multi-component high entropy alloy manufactured by this method may have unique physical and mechanical properties compared to conventional alloys due to its simple crystal structure.

Meanwhile, since a high-temperature process is required to form the high entropy alloy powder, mass production is difficult. In addition, there is a problem in that it is difficult to easily control the size of the alloy powder to be produced.

Therefore, there is a need for a new alloy powder manufacturing method and an alloy powder manufactured by the method that may solve the above problems

DISCLOSURE

Technical Problem

An embodiment relates to a method for manufacturing an alloy powder that can be easily produced and has a nanometer-sized particle diameter, and an alloy powder manufactured thereby.

Technical Solution

A method for manufacturing alloy powder according to an embodiment includes: a mixing a plurality of metal compounds to form a mixture; and a heat-treating the mixture, in the heat-treating the mixture, a process temperature varies according to the particle diameter of the alloy powder.

Advantageous Effects

The alloy powder manufacturing method according to the embodiment may manufacture a high entropy alloy powder at a low temperature.

That is, since the alloy powder may be produced at a low reduction temperature after mixing a plurality of metal salts, a low-temperature process may be performed.

Therefore, the alloy powder manufacturing method according to the embodiment may improve process efficiency and facilitate mass production of the alloy powder.

In addition, the alloy powder manufacturing method according to the embodiment may easily control the particle diameter of the alloy powder to be produced. That is, it is possible to control the particle diameter of the alloy powder produced by controlling the alloy powder process temperature.

Therefore, the alloy powder manufacturing method according to the embodiment may easily manufacture alloy powder having a desired particle diameter.

In addition, the alloy powder manufacturing method according to the embodiment may easily control the properties of the alloy powder to be manufactured. That is, the composition of the alloy powder may be easily controlled according to the characteristics of the alloy powder to be produced.

DESCRIPTION OF DRAWINGS

FIG. 1 is a view for explaining a process flow chart of an alloy powder manufacturing method according to an embodiment.

FIG. 2 is a graph for explaining the particle diameter of the alloy powder according to the process temperature of the alloy powder manufacturing according to the embodiments.

FIG. 3 is a view showing the crystalline of the metal salt mixture according to the process temperature of the alloy powder manufacturing according to embodiments.

FIG. 4 is a view showing a scanning electron microscope-energy dispersive analyzer (SEM-EDX) photograph of an alloy powder prepared by the alloy powder manufacturing method according to an embodiment.

FIG. 5 is a HADDF (High Angle Annular Dark Field) photograph of the alloy powder produced by the alloy powder manufacturing method according to the embodiment.

FIG. 6 is a graph for explaining an overvoltage according to a compound.

MODES OF THE INVENTION

Hereinafter, embodiments of the present invention will be described in detail with reference to the accompanying drawings. However, the spirit and scope of the present invention is not limited to a part of the embodiments described, and may be implemented in various other forms, and within the spirit and scope of the present invention, one or more of the elements of the embodiments may be selectively combined and replaced.

In addition, unless expressly otherwise defined and described, the terms used in the embodiments of the present invention (including technical and scientific terms) may be construed the same meaning as commonly understood by one of ordinary skill in the art to which this invention belongs, and the terms such as those defined in commonly used dictionaries may be interpreted as having a meaning that is consistent with their meaning in the context of the relevant art.

In addition, the terms used in the embodiments of the present invention are for describing the embodiments and are not intended to limit the present invention. In this specification, the singular forms may also include the plural forms unless specifically stated in the phrase, and may include at least one of all combinations that may be combined in A, B, and C when described in "at least one (or more) of A (and), B, and C".

Further, in describing the elements of the embodiments of the present invention, the terms such as first, second, A, B, (a), and (b) may be used. These terms are only used to distinguish the elements from other elements, and the terms are not limited to the essence, order, or order of the elements.

In addition, when an element is described as being "connected", or "coupled" to another element, it may include not only when the element is directly "connected" to, or "coupled" to other elements, but also when the element is "connected", or "coupled" by another element between the element and other elements.

Further, when described as being formed or disposed "on (over)" or "under (below)" of each element, the "on (over)" or "under (below)" may include not only when two elements are directly connected to each other, but also when one or more other elements are formed or disposed between two elements.

Furthermore, when expressed as "on (over)" or "under (below)", it may include not only the upper direction but also the lower direction based on one element.

Hereinafter, an alloy powder and preparation method thereof will be described with reference to drawings.

Referring to FIG. 1, a method for manufacturing alloy powder according to an embodiment may include forming a mixture (ST10) and heat-treating the mixture (ST20).

In the step of forming the mixture (ST10), a mixture may be formed by mixing metal compounds. The metal compound may be a metal compound including at least one of cobalt (Co), copper (Cu), iron (Fe), nickel (Ni), and ruthenium (Ru). That is, the metal compound may be a metal salt including at least one of the metals.

For example, the metal compound may include at least one metal salt of carbonate, nitrate, halide, sulfate, acetate, acetylacetonate, and perchlorate, which include at least one metal among the metals.

The metal compounds may be mixed by various methods to form a mixture.

For example, the metal compounds may be added to a container containing methanol and mixed in a solvent using a stirrer to form a mixture. Then, the methanol may be evaporated to form a mixed powder in which the metal compounds are mixed. Meanwhile, for a more uniform mixing, it can be additionally ground for about 30 minutes using an agate mortar after drying.

The mixture may be formed by mixing at least three metal compounds. Alternatively, the mixture may be formed by mixing at least four or more metal compounds. Alternatively, the mixture may be formed by mixing at least 5 or more metal compounds.

Then, in the step of heat-treating the mixture (ST20), the previously produced mixtures of metal compounds may be heat-treated.

In detail, after the mixture is introduced into the reactor, heat treatment may be performed by heating the temperature inside the reactor to 300° C. to 700° C. by applying an electric current to a heat source that transfers heat to the reactor.

In this case, the process pressure may be about 7000 Pa or less. In detail, heat treatment may be performed for 1 hour to 2 hours at a pressure of 10 Pa to 7000 Pa in a gas atmosphere containing hydrogen gas.

The metal compounds may be reduced by the hydrogen gas, and metals included in the metal compound may react to form an alloy powder.

In detail, the heat-treating the mixture (ST20) may be performed by a hydrogen reduction method. That is, a metal may be reduced from an aqueous solution of a metal salt using hydrogen gas, and the reduced metal may be bonded to form an alloy powder.

The metal salt may be reduced by the following reaction formula.

$MCl_2$ (M=Co,Cu,Fe,Ni)

$$MCl_2+H_2=M+2HCl \quad \text{[Formula 1]}$$

$MCl_3$ (M=Ru)

$$2MCl_3+3H_2=2M+6HCl \quad \text{[Formula 2]}$$

That is, cobalt, copper, iron, nickel, and ruthenium are reduced by the hydrogen reduction method, and cobalt, copper, iron, nickel, and ruthenium form a CoCuFeNiRu compound to form an alloy powder. In detail, it is possible to form an alloy powder having an atomic percentage of cobalt, copper, iron, nickel and ruthenium of 1:1:1:1:1.

Accordingly, alloy powder, that is, high entropy alloy powder may be finally formed.

Meanwhile, the heat-treating the mixture (ST20) may be performed in a plurality of steps. In detail, the heat-treating the mixture (ST20) includes a first step of controlling the process temperature to the reaction temperature of the mixture, a second step of setting the process temperature according to the particle size, and a third step in which the process temperature is changed to a process temperature set according to the particle diameter size to react metals reduced in metal compounds.

In detail, in the first step of controlling the process temperature to the reaction temperature of the mixture, the process temperature may be controlled to a temperature at which the mixture including the metal compound may be reduced.

That is, in order to separate the metal of the metal compounds, the metal compounds may be reduced in a hydrogen atmosphere, and the metals separated from the metal compounds may react to form an alloy powder.

Accordingly, in the first step in which the process temperature is controlled to the reaction temperature of the mixture, the process temperature may be increased to the reduction temperature of the metal compound. That is, in the first step, the mixture may be heat-treated by raising the temperature to a temperature at which metal salts are reduced to produce an alloy powder.

In detail, the first step may be heat-treated in a process temperature range of 400° C. to 500° C.

In the second step of setting the processing temperature according to the particle diameter, the processing temperature may be set differently according to the desired particle diameter of the alloy powder.

In detail, the particle diameter of the alloy powder may change according to the process temperature. That is, the particle diameter of the alloy powder may be inversely proportional to the size of the process temperature. That is, when the process temperature increases when the metal compound is reduced, the aggregation of the metals increases, and accordingly, the particle diameter of the metal compounds may increase as the process temperature increases.

Accordingly, in the second step, it is possible to control the particle diameter of the alloy powder to be manufactured by setting various process temperatures according to the desired particle diameter. That is, the particle diameter of the alloy powder prepared by the alloy powder manufacturing method according to the embodiment may be controlled to a size of 50 nm to 700 nm according to the temperature.

In the third step in which the process temperature is controlled to a reaction temperature of metals reduced from a metal compound, the process temperature may be controlled to a temperature at which metals ionized by reduction of the metal compounds react.

In detail, the reaction temperature may be controlled according to the particle diameter of the alloy powder set in the second step.

That is, the metal compounds may be reduced in a hydrogen atmosphere to form metal ions, and the metal ions may react with each other within a specific temperature range to form alloy powder.

Accordingly, in the third step in which the process temperature is controlled by the reaction temperature of metals reduced from the metal compound, the alloy powder may be formed by controlling the reaction temperature of the metal ions according to the particle diameter of the alloy powder.

In detail, the third step may be heat-treated in a process temperature range of 400° C. to 500° C.

The alloy powder manufacturing method according to the embodiment may manufacture a high entropy alloy powder at a low temperature.

That is, since the alloy powder may be produced at a low reduction temperature after mixing a plurality of metal salts, a low-temperature process may be performed.

Therefore, the alloy powder manufacturing method according to the embodiment may improve process efficiency and facilitate mass production of the alloy powder.

In addition, the alloy powder manufacturing method according to the embodiment may easily control the particle diameter of the alloy powder to be produced. That is, it is possible to control the particle diameter of the alloy powder produced by controlling the alloy powder process temperature.

Therefore, the alloy powder manufacturing method according to the embodiment may easily manufacture alloy powder having a desired particle diameter.

Hereinafter, the present invention will be described in more detail through the alloy powder manufacturing method according to Examples and Comparative Examples. These production examples are only presented as examples in order to explain the present invention in more detail. Therefore, the present invention is not limited to these production examples.

Example 1

A mixture was formed by mixing 237.93 mg of $CoCl_2$-$6H_2O$, 170.48 mg of $CuCl_2$-$2H_2O$, 198.81 mg of $FeCl_2$-$4H_2O$, 237.69 mg of $NiCl_2$-$6H_2O$ and 261.47 mg of hydrated $RuCl_3$. In detail, a mixed powder in which the metal salts were mixed was formed by dissolving the metal salts in methanol and then evaporating the methanol.

Subsequently, after filling the mixed powder in an alumina boat, the heating temperature was 20° C./min in a tube furnace, and heat treatment was performed at a process temperature of 300° C. and a pressure of 10 Pa to 7000 Pa.

At this time, hydrogen gas was introduced into the tube furnace at a flow rate of 50 sccm, and the heat treatment was performed for about 1 hour to produce alloy powder.

Example 2

Alloy powder was produced in the same manner as in Example 1, except that the process temperature was 600° C.

Example 3

Alloy powder was produced in the same manner as in Example 1, except that the process temperature was 700° C.

Referring to FIG. 2, it can be seen that the particle diameter of the alloy powder according to the embodiment is changed according to the process temperature. That is, it can be seen that the particle diameter of the alloy powder increases as the process temperature increases.

Accordingly, since the alloy powder produced by the alloy powder manufacturing method according to the embodiment may control the particle diameter of the alloy powder according to the process temperature during the process, it is possible to easily manufacture the alloy powder having a desired particle diameter.

In addition, it can be seen that the alloy powder manufacturing method according to the embodiment may form the alloy powder at a low temperature of 300° C. to 700° C.

Conventionally, when manufacturing alloy powder, since it is manufactured by an ingot growth method and requires a high-temperature process of 1500° C. or more, process efficiency is reduced and mass production is difficult.

However, since the alloy powder manufacturing method according to the embodiment produces the alloy powder by reducing the metal salt, the alloy powder may be manufactured at a low temperature, and accordingly, the alloy powder manufacturing method according to the embodiment has improved process efficiency and a mass production becomes easier.

FIG. 3 is a view showing the crystallinity of a metal salt mixture according to process temperature in a hydrogen atmosphere.

Referring to FIG. 3, it may be seen that the process temperature of about 120° C. is a temperature at which moisture contained in the mixture is removed, and reduction of the metal salt (Cobalt, Copper, Iron, Nickel, Ruthenium) by hydrogen does not occur and the metal salts are randomly mixed, and thus the mixture does not have crystallinity. In addition, when the process temperature is increased to 200° C. to 300° C., reduction by hydrogen does not occur, but it can be seen that the crystallinity of the metal salt mixture is partially improved by the increased temperature. Also, when the process temperature reaches 400° C., the metal salt mixture starts to be reduced to a metal compound by hydrogen. However, it can be confirmed that the metal compound formed at 400° C. has low crystallinity, and when the process temperature is raised to 500° C., the crystallinity of the metal compound is improved. The produced metal compound is confirmed to have fcc and hcp structures, and X-ray diffraction peaks due to the corresponding structure may be confirmed at 43°, 50°, 74° (fcc) and 40°, 43°, 45°, 60°, and 72° (hcp).

FIGS. 4 and 5 are views showing the results of analyzing the shape and element distribution of the produced metal compound by scanning electron microscopy (SEM), scanning transmission electron microscopy (STEM), and energy dispersive spectroscopy (EDS).

As may be seen from the SEM image of FIG. 4, the diameter of the produced metal compound is confirmed to be approximately 80 nm, and it may be seen that constituent elements forming the metal compound, that is, Co, Cu, Fe, Ni, and Ru, are uniformly distributed in the entire surface thereof by SEM-EDS. Uniform mixing of constituent elements can be confirmed even in a microscopic area, and may be confirmed through the STEM-EDS image of FIG. 5. It can be seen that elements constituting a metal compound are uniformly distributed not only in the overall region but also in the local particle unit without bias of a specific element, and referring to the SEM and STEM results, it can be seen that the metal alloy powder can be formed without a problem under the above conditions.

FIG. 6 is a graph for explaining overvoltages of CoCuFeNiRu alloy, CoCuFeNi alloy, and Ru metal.

Referring to FIG. 6, it can be seen that the overvoltage of the CoCuFeNiRu alloy formed by the alloy powder manufacturing method using the hydrogen reduction process according to the embodiment is reduced compared to the CoCuFeNi alloy and the Ru metal. In addition, it can be seen that the CoCuFeNiRu alloy may obtain a large current with a low overvoltage compared to the CoCuFeNi alloy and the Ru metal.

That is, it can be seen that the CoCuFeNiRu alloy formed by the alloy powder manufacturing method using the hydrogen reduction process according to the embodiment may have the same effect even with small energy, and thus may have improved efficiency.

The characteristics, structures, effects, and the like described in the above-described embodiments are included in at least one embodiment of the present invention, but are not limited to only one embodiment. Furthermore, the characteristic, structure, and effect illustrated in each embodiment may be combined or modified for other embodiments by a person skilled in the art. Accordingly, it is to be understood that such combination and modification are included in the scope of the present invention.

In addition, embodiments are mostly described above, but the embodiments are merely examples and do not limit the present invention, and a person skilled in the art may appreciate that several variations and applications not presented above may be made without departing from the essential characteristic of embodiments. For example, each component specifically represented in the embodiments may be varied. In addition, it should be construed that differences related to such a variation and such an application are included in the scope of the present invention defined in the following claims.

What is claimed is:

1. A method for manufacturing of a metal alloy powder comprising:

mixing a plurality of metal compounds to form a mixture; and heat-treating the mixture having the plurality of metal compounds, wherein in the heat-treating the mixture, a process temperature varies according to a particle diameter of the metal alloy powder, and a relationship between the process temperature and the particle diameter is positive, wherein the plurality of metal compounds include at least one of cobalt (Co), copper (Cu), iron (Fe), nickel (Ni), or ruthenium (Ru), wherein the plurality of metal compounds include a metal salt of at least one of chloride, carbonate, nitrate, halide, sulfate, acetate, acetylacetonate, or perchlorate, wherein the heat-treating the mixture having the plurality of metal compounds comprises:

controlling the process temperature to a first reaction temperature for the mixture at a first temperature of over 400° C. to 500° C.;

setting the process temperature according to the particle diameter; and controlling the process temperature to a second reaction temperature for a plurality of reduced metal compounds at a second temperature of 500° C. to 700° C., wherein the heat-treating the mixture is performed in a hydrogen gas atmosphere, wherein the metal salt comprises the chloride, and the metal salt is reduced by reaction Formula 1 and reaction Formula 2:

$MCl_2$ (M=Co,Cu,Fe,Ni)

$MCl_2+H_2=M+2HCl$ Formula 1:

$MCl_3$ (M=Ru)

$2MCl_3+3H_2=2M+6HCl$ Formula 2:

to form a reduced metal alloy powder comprising CoCuFeNiRu having an atomic ratio of cobalt, copper, iron, nickel and ruthenium of 1:1:1:1:1, and wherein the particle diameter of the metal alloy powder is 80 nm to 700 nm.

* * * * *